United States Patent [19]

Parsons

[11] 4,240,171

[45] Dec. 23, 1980

[54] SWIMMER'S AID

[76] Inventor: William N. Parsons, 6455 Custer St., Hollywood, Fla. 33313

[21] Appl. No.: 60,851

[22] Filed: Jul. 26, 1979

[51] Int. Cl.[3] ..... A63B 31/02

[52] U.S. Cl. ..... 9/307; 9/310 J; 272/1 B

[58] Field of Search ..... 9/14, 301, 307, 310 R, 9/310 A, 310 B, 310 E, 310 J, 303; 115/6.1, 70; 114/242, 253, 254; 272/1 B

[56] References Cited

U.S. PATENT DOCUMENTS

| | | | |
|---|---|---|---|
| 2,290,943 | 7/1942 | Conley | 9/307 |
| 2,593,321 | 4/1952 | Lindgren | 272/1 B |
| 3,146,470 | 9/1964 | Hamblin | 9/307 |
| 3,174,702 | 3/1965 | French | 9/310 R X |
| 3,181,493 | 5/1965 | Perkut | 115/6.1 |
| 3,830,188 | 8/1974 | Humbert | 9/310 A X |

*Primary Examiner*—Douglas C. Butler
*Attorney, Agent, or Firm*—Oltman and Flynn

[57] ABSTRACT

The present swimmer's aid has a centrally positioned hand grip arrangement for receiving the swimmer's hands close together and flotation elements extending laterally outward on both sides beyond the hand grip arrangement for flotation stability.

9 Claims, 10 Drawing Figures

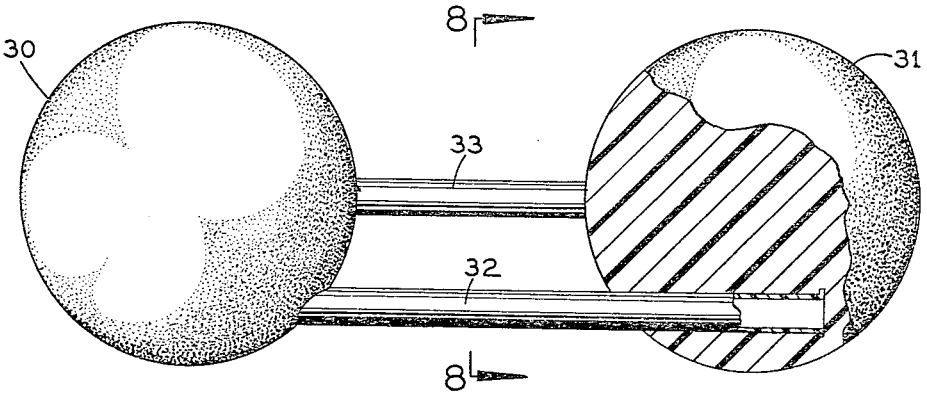
FIG. 7
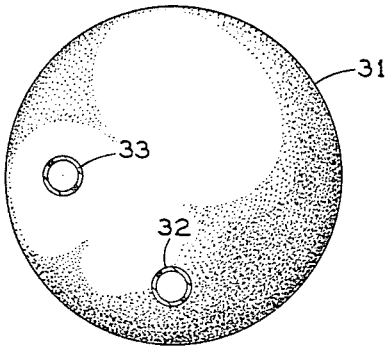
FIG. 8
FIG. 9
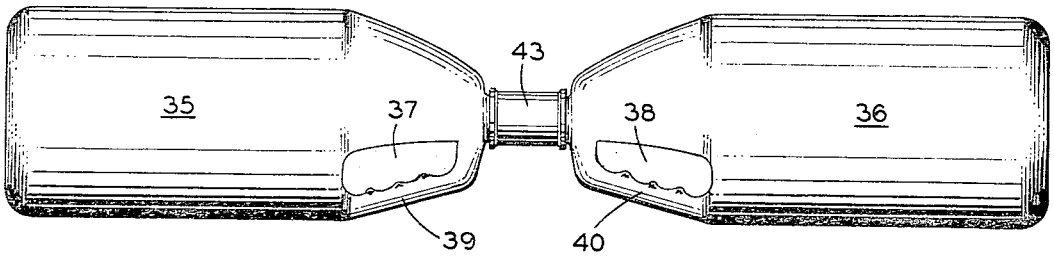
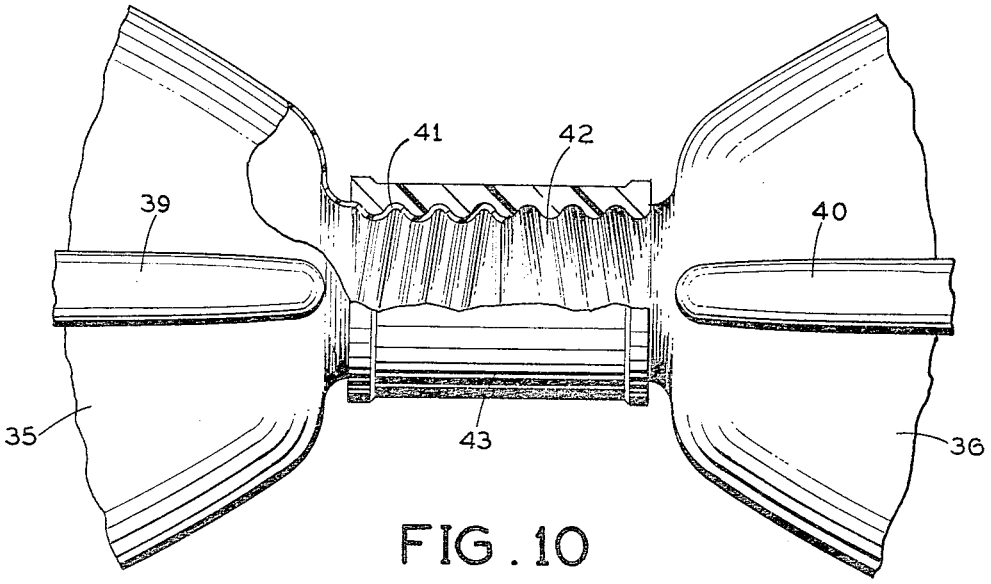
FIG. 10

SWIMMER'S AID

BACKGROUND OF THE INVENTION

Various hand-held aids for swimmers have been proposed heretofore to buoy a beginning swimmer's confidence in the water by enhancing his ability to float or to propel himself through the water. For example, U.S. Pat. No. 2,593,321 shows a handle suspended from a float which is centered above the handle. Other examples of swimmer's aids are shown in the following U.S. Pat. Nos.: Learman 1,008,653, Babbitt 1,971,844, Ferber 2,006,915, Eriksen 3,510,894, Clemente 3,802,009 and Persson 3,889,308.

The present invention is directed to a novel swimmer's aid which facilitates the instruction of a beginning swimmer and which may be used by a swimmer in performing a variety of different maneuvers in the water with or without the assistance of a swimming instructor, including a prone float, a prone glide with or without kicking, a back glide with or without kicking, a back float, turning over from back to front while kicking (or vice versa), and leveling off from a vertical position to a horizontal position while kicking.

A principal object of this invention is to provide a novel and improved swimmer's aid.

Another object of this invention is to provide a novel swimmer's aid which may be used for the various different maneuvers specified above.

Another object of this invention is to provide a novel swimmer's aid having an improved arrangement for stabilizing a neophyte swimmer in the water.

Another object of this invention is to provide a swimmer's aid of novel construction which greatly assists the beginning swimmer to assume a level prone position in the water.

Another object of this invention is to provide a novel swimmer's aid having a hand grip arrangement which assists the beginning swimmer to keep his hands up at the proper level in the water.

Further objects and advantages of this invention will be apparent from the following detailed description of three presently-preferred embodiments, which are illustrated in the accompanying drawings.

DESCRIPTION OF THE DRAWINGS

FIG. 7 is an elevational view, with parts broken away for clarity, of a second embodiment of the present invention;

FIG. 8 is a vertical cross-section taken along the line 8—8 in FIG. 7;

FIG. 9 is an elevational view of a third embodiment of this invention; and

FIG. 10 is an enlarged elevational view taken at the middle of the swimmer's aid in FIG. 9, with certain parts broken away for clarity.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
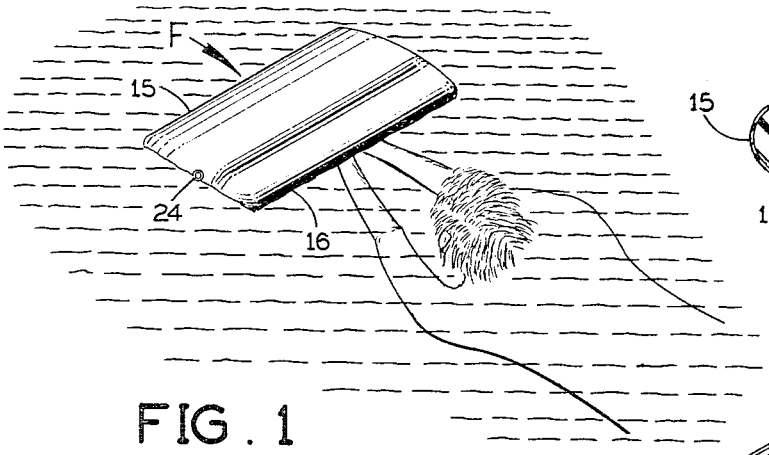
FIG. 1 is a perspective view of a first embodiment of the present invention being used by a swimmer in the water.
Figure 4:
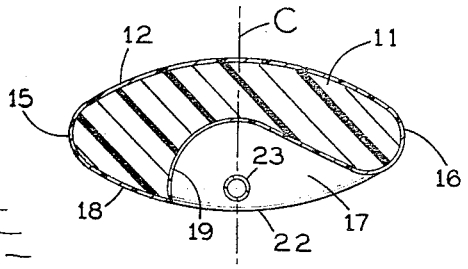
FIG. 4 is a vertical cross-section taken along the line 4—4 in FIG. 2.
Figure 2:
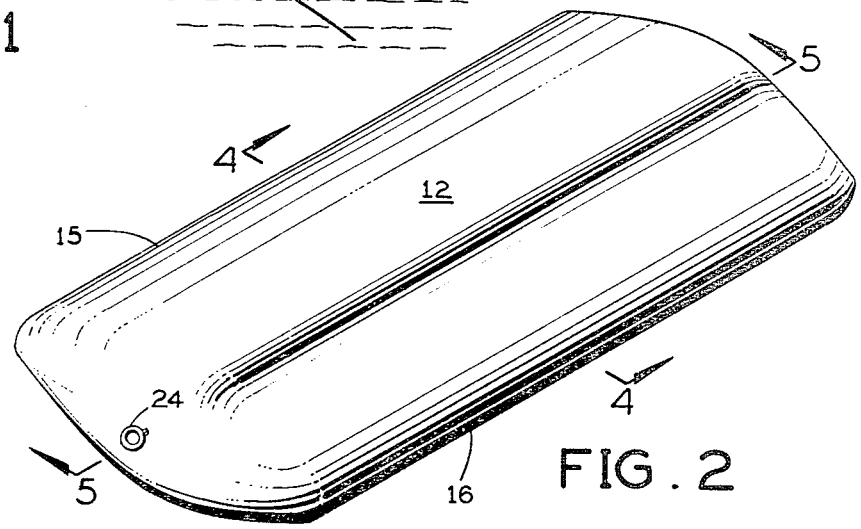
FIG. 2 is a top perspective view of this embodiment of the present swimmer's aid.
Figure 5:
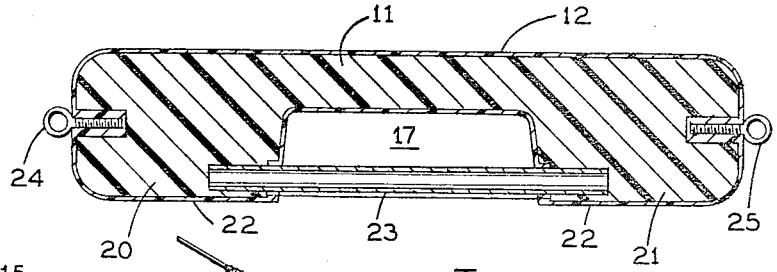
FIG. 5 is a vertical longitudinal section taken along the line 5—5 in FIG. 2.
Figure 3:
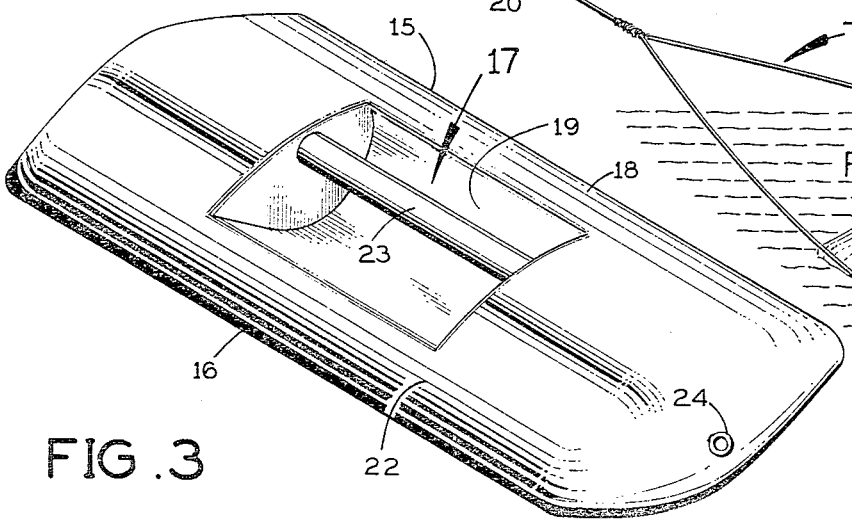
FIG. 3 is a bottom perspective view of the FIG. 2 swimmer's aid.

Referring first to FIGS. 1–6, the swimmer's aid shown there is a streamlined float member F which preferably is slightly wider than the swimmer's shoulders. In the embodiment illustrated it comprises a lightweight core 11 (FIGS. 4 and 5) of expanded plastic foam, such as polyurethane foam, covered by a watertight skin 12 of any suitable material. However, it is to be understood that this float member may be hollow and filled with air or any suitable light weight gas. The float member is generally elliptical in cross-section from its rounded leading edge 15 to its rounded, trailing edge 16, and it is generally rectangular from side to side, as best seen in FIGS. 2 and 5.

As shown in FIG. 4, midway along its length the float member F has a downwardly-faced recess 17 in the bottom. At its front end this recess makes a substantially right-angled intersection with the bottom surface 18, which curves downward and rearward from the leading edge 15 of the float member, forming a rearwardly-facing, upwardly-extending, internal shoulder 19 at this intersection which is located beyond the front-to-back centerline C (FIG. 4) toward the leading edge 15. From this shoulder the surface of the recess 17 curves upward and rearward to the front-to-back centerline C, and then curves downward and rearward from this centerline to a point slightly forward of the trailing edge 16 where its curvature reverses to merge smoothly with the upward and rearward curvature of the bottom surface of the float member on either side of the recess 17.

As shown in FIG. 5, the bottom recess 17 occupies approximately the middle third of the float member F in a side-to-side direction. On opposite sides of this recess the float member presents downwardly-projecting flotation segments 20 and 21, each of which takes up about one-third of the width of the float member. At each of these downwardly-projecting flotation segments the float member presents a generally elliptical bottom surface 22 which is a smooth, uninterrupted continuation of the bottom surface 18 extending across the full width of the float member forward of the recess 17.

A hollow bar or rod 23 extends horizontally across the recess 17 from side to side, with its opposite ends being anchored in the respective downwardly projecting floatation segments 20 and 21. This bar is positioned at the front-to-back centerline C and close to the bottom of the float member, providing a substantial clearance between the bar and the entire surface of the bottom recess 17 in the float member.

The bar 23 serves as a hand grip for the swimmer, who will insert his hands into the bottom recess 17 from the trailing edge 16 of the float member, with his fingers passing over the top of the bar 23 to grip it. The width of the bar 23 in the bottom recess 17 is such that the swimmer's hands will be positioned close together side by side. Preferably, the space between the bar 23 and the shoulder 19 at the front of the recess 17 is large enough for a swimming instructor to insert his fingers in front of the beginning swimmer's fingers on the bar 23, so that the instructor may pull the float member forward in the water.

Figure 6:
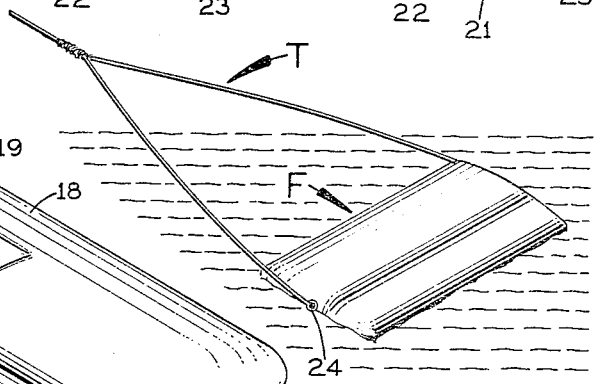
FIG. 6 shows the swimmer's aid of FIG. 2 being pulled through the water by a tow line.

A pair of eyes 24 and 25 are anchored to the float member on its opposite sides for the attachment of a bifurcated tow line T, as shown in FIG. 6.

Thus, the beginning swimmer can use the float member alone, as shown in FIG. 1, or with an instructor pulling or guiding him by hand or by the use of the tow line T as illustrated in FIG. 6. The float member can be towed either at or below the surface of the water.

The position of the hand grip bar 23 is such that the swimmer's hands will be centered in front of his head, assisting him to float or to glide in the water with or without kicking. The vertical thickness of the float member F is relatively small so as not to obstruct the swimmer's vision. The width of the float member and the location of its downwardly projecting flotation segments 20 and 21 on opposite sides of the handle bar 23 provides exceptionally good stability, which helps to build the beginning swimmer's confidence in its ability to support him in a stabilized floating position. In use, the handle bar 23 will be below the water level, and this facilitates keeping the swimmer in the proper, substantially horizontal position in the water with his hands up at the correct level just below the surface of the water.

As the swimmer becomes more proficient and confident, the float member may be used by him to perform various more advanced maneuvers in the water, such as gliding on his back while holding the float member over his stomach, floating on his back while holding a float member in each hand, turning over from his stomach onto his back or vice versa, or leveling off from a vertical position to a horizontal position.

In the second embodiment of the invention, shown in FIGS. 7 and 8, a pair of spherical float balls 30 and 31 are fastened to the opposite ends of a hollow bar or rod 32, which provides the hand grip for the swimmer. These balls may be of expanded plastic foam with a water-tight skin, or they may be inflated hollow balls. The swimmer's handle bar 32 is attached to each float ball off-center, so that in use in the water this bar will be below the horizontal centerline of the balls.

Preferably, a second hollow bar 33 is attached to the float balls off-center one quarter turn from the bar 32. The bar 33 may be grasped by the instructor to pull or guide the swimmer in the water. However, this second bar 33 may be omitted, if desired.

FIGS. 9 and 10 show a third embodiment of the invention in which the flotation means comprises a pair of hollow jugs 35 and 36 of known design, such as those used for liquid laundry products, such as liquid detergent or chlorine. The jugs are formed with respective hand openings 37 and 38. Each hand opening is located between the main body of the jug at its inwardly tapered pouring end and a respective handle 39 or 40 on the outside at this end. The tapered end of each jug terminates in a respective reduced neck 41 or 42, which is externally screw-threaded. A rigid connector sleeve 43 is internally screw-threaded for threadedly engaging these necks to hold them end-to-end as shown in FIG. 10.

With this arrangement, the swimmer grasps the handle 39 with his left hand and the handle 40 with his right hand to use the connected jugs as a swimmer's aid. As with the previously described embodiments, the apparatus of FIGS. 9 and 10 provides flotation members extending laterally outward beyond the hand grip means provided by the handles 39 and 40 for flotation stability. This apparatus may be used as a floating gymnastic "bar" by the swimmer in performing front or back flips or various other maneuvers in the water. The connector sleeve 43 can be used as a rest for the swimmer's chin or feet while floating.

I claim:

1. A swimmer's aid comprising;

hand grip means for engagement simultaneously by both of the swimmer's hands;

and flotation means attached to said hand grip means and extending laterally outward on each side beyond said hand grip means to provide flotation stability;

said flotation means comprising a unitary float member having an upwardly convex top surface and a downwardly convex bottom surface, said float member also having a downwardly-facing recess in its bottom midway across its lateral extent, said float member presenting downwardly-projecting flotation segments on opposite laterally outer sides of said recess;

and said hand grip means comprises a bar within said recess anchored at its opposite ends in said downwardly-projecting segments of the float member, said bar extending laterally across said recess spaced far enough from the bottom surface of the float member within said recess to permit the swimmer's fingers to extend over the bar.

2. A swimmer's aid according to claim 1 wherein said float member has a tapered leading edge.

3. A swimmer's aid according to claim 1 wherein said float member has a tapered, rounded leading edge and a tapered, rounded trailing edge.

4. A swimmer's aid according to claim 1 wherein said bar is located substantially midway between the leading and trailing edges of said float member.

5. A swimmer's aid according to claim 1 wherein:

said bottom surface extends rearward from its leading edge and intersects said recess forwardly of said bar.

6. A swimmer's aid according to claim 5 wherein said bottom surface is inclined downward and rearward from the leading edge of the float member.

7. A swimmer's aid according to claim 6 wherein said float member has a tapered, rounded leading edge in front of said bottom surface and a tapered, rounded trailing edge behind said recess.

8. A swimmer's aid according to claim 7, and further comprising eyes on the opposite sides of said float member for the attachment of a tow line for pulling the float member through the water.

9. A swimmer's aid according to claim 1 and further comprising attachment members fastened to the opposite sides of said float member and attachable to a tow line.

* * * * *